US011051364B2

(12) United States Patent
Qiu et al.

(10) Patent No.: US 11,051,364 B2
(45) Date of Patent: Jun. 29, 2021

(54) CONTROL METHOD OF ELECTRONIC CIGARETTE AND ELECTRONIC CIGARETTE THEREOF

(71) Applicant: Changzhou Patent Electronic Technology Co., LTD, Jiangsu (CN)

(72) Inventors: Weihua Qiu, Jiangsu (CN); Neng Hua, Jiangsu (CN)

(73) Assignee: Changzhou Patent Electronic Technology Co., LTD, Jiangsu (CN)

( * ) Notice: Subject to any disclaimer, the term of this patent is extended or adjusted under 35 U.S.C. 154(b) by 344 days.

(21) Appl. No.: 16/254,188

(22) Filed: Jan. 22, 2019

(65) Prior Publication Data

US 2019/0223502 A1 Jul. 25, 2019

(30) Foreign Application Priority Data

Jan. 22, 2018 (CN) ..... 201810058918.X
Jan. 22, 2018 (CN) ..... 201820106661.6

(51) Int. Cl.

| | |
|---|---|
| ***H05B 1/02*** | (2006.01) |
| ***A24F 40/44*** | (2020.01) |
| ***A24F 40/48*** | (2020.01) |
| ***A24F 40/53*** | (2020.01) |
| *A24F 40/10* | (2020.01) |
| *A24F 40/485* | (2020.01) |

(52) U.S. Cl.

CPC ..... *H05B 1/0227* (2013.01); *A24F 40/44* (2020.01); *A24F 40/48* (2020.01); *A24F 40/53* (2020.01); *H05B 1/0297* (2013.01); *A24F 40/10* (2020.01); *A24F 40/485* (2020.01)

(58) Field of Classification Search

CPC .. H05B 1/0227; H05B 1/0297; H05B 1/0202; A24F 40/40; A24F 40/44; A24F 40/48; A24F 40/485; A24F 40/10; A24F 40/50; A24F 40/51; A24F 40/53; A24F 40/57; A24F 40/60; A24F 25/00; A24F 25/02

USPC ..... 131/328

See application file for complete search history.

(56) References Cited

U.S. PATENT DOCUMENTS

| | | | | |
|---|---|---|---|---|
| 9,888,723 | B2 * | 2/2018 | Cameron | A24F 47/008 |
| 10,390,563 | B2 * | 8/2019 | Hawes | H05B 3/0014 |
| 2015/0173124 | A1 * | 6/2015 | Qiu | G06F 13/387 131/328 |
| 2016/0213065 | A1 * | 7/2016 | Wensley | A24F 40/46 |
| 2017/0135404 | A1 * | 5/2017 | Reevell | A24F 40/70 |

(Continued)

*Primary Examiner* — Harshad C Patel

(74) *Attorney, Agent, or Firm* — Novick, Kim & Lee, PLLC; Allen Xue

(57) ABSTRACT

An electronic cigarette has an atomizing assembly that includes a first detecting device, a heating member for heating cigarette liquid, a liquid absorbing member for adsorbing excess cigarette liquid, a controller, and a pump body, which delivers the cigarette liquid to the heating member. The first detecting device detects the degree of saturation of the liquid absorbing member, and feedbacks to the controller. The controller pre-determines the difference between the degree of saturation of the liquid absorbing member and the first threshold value. When the degree of saturation is greater than or equal to the first threshold value, the controller controls the liquid absorbing member to maintain the current degree of saturation or to control the degree of saturation of the liquid absorbing member to be reduced.

20 Claims, 6 Drawing Sheets

(56) References Cited

U.S. PATENT DOCUMENTS

| | | | | |
|---|---|---|---|---|
| 2018/0279688 | A1* | 10/2018 | Qiu | A24F 40/85 |
| 2018/0343925 | A1* | 12/2018 | Wensley | A24F 40/50 |
| 2019/0223507 | A1* | 7/2019 | Qiu | A61M 15/06 |

* cited by examiner

CONTROL METHOD OF ELECTRONIC CIGARETTE AND ELECTRONIC CIGARETTE THEREOF

FIELD

The present disclosure relates to the technical field of electronic cigarette, in particular to a control method of an electronic cigarette and an electronic cigarette thereof.

BACKGROUND

At present, e-cigarettes have become a relatively mature alternative to smoking on the market. The battery supplies power to the heating assembly of the atomizing device of the e-cigarette, so that the heating assembly heats the cigarette liquid under electric driving to generate smoke for the user to smoke. When the heating assembly cannot atomize the cigarette liquid supplied by the liquid storage device in time, the excess cigarette liquid in the atomizing device may leak, affecting the user's use, and also causing waste of the cigarette liquid.

SUMMARY

The present disclosure provides a control method of an electronic cigarette to reduce the risk of liquid leakage, and an electronic cigarette using the method.

A control method of an electronic cigarette, the atomizing assembly includes a first detecting device, a heating member, a liquid absorbing member, a controller, and a pump body, the pump body is configured to supplying the cigarette liquid to the heating member, the heating member is for heating the cigarette liquid, the liquid absorbing member is for adsorbing excess cigarette liquid, the control method includes: the first detecting device detects the degree of saturation of the liquid absorbing member, and feedback to the controller; the controller compares the degree of saturation of the liquid absorbing member with the first threshold value; and when the degree of saturation is greater than or equal to the first threshold, the controller controls the liquid absorbing member to maintain the current degree of saturation or to control the degree of saturation of the liquid absorbing member to be reduced.

In one embodiment, the control method further includes the following step after comparing the degree of saturation of the liquid absorbing member with the first threshold value: when the degree of saturation is less than the first threshold value, returning to the step of detecting the degree of saturation of the liquid absorbing member by the first detecting device and feeding back to the controller.

In one embodiment, the electronic cigarette further includes an alarm device, the method for controlling the electronic cigarette further includes: when the degree of saturation is greater or less than the first threshold value, the controller instructs the alarm device to transmit an alarm signal.

In one embodiment, the step of controlling the liquid absorbing member to maintain the current degree of saturation or to control the decrease in the degree of saturation of the liquid absorbing member includes the following step, the controller controls circuit between the pump body and the power source to be opened, and/or controls circuit between the heating element and the power source to be turned on, to make the heating element operates for a certain period of time.

In one embodiment, the control method further includes following steps after controlling circuit between the pump body and the power source to be opened, and/or controls circuit between the heating element and the power source to be turned on, to make the heating element operates for a certain period of time: the first detecting device detects the degree of saturation of the liquid absorbing member and feeds back to the controller; the controller compares the degree of saturation of the liquid absorbing member with a second threshold value stored in advance; when the degree of saturation is greater than the second threshold value, the controller controls the circuit between the pump body and the power source to be opened, and controls the circuit between the heating member and the power source to be turned on, so that the heating member operates for a certain period of time; the second threshold value is less than the first threshold value.

In one embodiment, the control method further includes the following step after comparing the degree of saturation of the liquid absorbing member with a second threshold value stored in advance: when the degree of saturation is less than or equal to the second threshold value, the controller controls the circuit between the pump body and the power source to be turn on and the circuit between the heating element and the power source to be turn on, so that the pump body and the heating element work for a certain period of time.

In one embodiment, the control method further includes the steps of: when the degree of saturation is less than or equal to the second threshold value, the controller receives the shutdown signal of the pump body and the shutdown signal of the heating element; the controller controls circuit between the pump body and the power source to be opened and controls circuit between the heating element and the power source to be opened.

In one embodiment, control method further includes: the controller receives a shutdown signal of the pump body and a shutdown signal of the heating element; the controller controls a circuit between the pump body and the power source to be opened; the first detecting device detects the degree of saturation of the liquid absorbing member and feeds back to the controller; the controller compares the degree of saturation of the liquid absorbing member with a third threshold value stored in advance; when the degree of saturation is less than or equal to the third threshold value, the controller controls the circuit between the heating element and the power source to be opened, the third threshold value is less than the first threshold value.

In one embodiment, the control method further includes following steps after comparing the degree of saturation of the liquid absorbing member with a third threshold value stored in advance: when the degree of saturation is greater than the third threshold value, the controller controls the circuit between the heating element and the power source to keep connecting, so that the heating element continues to operate for a certain period of time, and then the first detecting device detects the degree of saturation of the liquid absorbing member, and feedback to the controller.

An electronic cigarette for performing any one of the above methods.

An electronic cigarette includes a first detecting device, a pump body, a heating member, a liquid absorbing member, a power source, and a controller, the liquid absorbing member configured for absorbing excess cigarette liquid, the pump body is configured to supply the liquid to the heating member, the heating member is configured to heat the cigarette liquid supplied by the pump body; the first detecting device is configured to detect the degree of saturation of the liquid absorbing member and feedback to the controller, the controller is configured to compare the degree of saturation of the liquid absorbing member with a first threshold value stored in advance; when the degree of saturation is greater than or equal to the first threshold value, the controller is configured to control the circuit between the pump body and the power sources to be opened, and/or control the circuit between the heating element and the power source to be connected to make the heating element operates for a certain period of time.

In one embodiment, the electronic cigarette further includes an alarm device, when the degree of saturation is greater than or equal to the first threshold value, the controller is further configured to instruct the alarm device to transmit an alarm signal.

In one embodiment, the controller is further configured to compare the degree of saturation of the liquid absorbing member with a second threshold value stored in advance; when the degree of saturation is less than or equal to the second threshold value, the controller controls the pump body and the power source are electrically continuous therewith, and also controls the heating element and the power source are electrically continuous therewith, so that the pump body and the heating element working for a certain period of time, the second threshold value is less than the first threshold value.

In one embodiment, the controller is further configured to compare the degree of saturation of the liquid absorbing member and a second threshold value stored in advance; when the degree of saturation is less than or equal to the second threshold value, the controller is configured to receive a shutdown signal of the pump body and a shutdown signal of the heating element; when the controller receives the shutdown signal of the pump body and the heating element the controller controls a circuit between the pump body and the power source to be opened and controls circuit between the heating element and the power source to be opened; the second threshold value is less than the first threshold value.

In one embodiment, the controller is further configured to receive a shutdown signal of the pump body and a shutdown signal of the heating member, and when the controller receives the shutdown signal of the pump body and the shutdown signal of the heating element, the controller is configured to control the circuit between the pump body and the power source to be opened; the controller is configured to compare the degree of saturation of the liquid absorbing member with a third threshold value stored in advance; when the degree of saturation is less than or equal to the third threshold value, the controller is configured to control a circuit between the heating element and the power source to be opened; the third threshold value is greater than the first threshold value.

In one embodiment, the liquid absorbing member is made of porous ceramic, the liquid absorbing member is disposed in attached to the heating member.

In one embodiment, the electronic cigarette further includes a liquid passage, a liquid intake hole, a liquid outlet, and a liquid storage assembly for storing the cigarette liquid; the liquid outlets are respectively in communication with the smoke liquid passage and the heating member; the liquid intake hole is respectively in communication with the smoke liquid passage and the pump body, the pump body cooperates with the liquid storage assembly, the pump body supplies the liquid smoke in the liquid storage assembly to the heating member through the liquid intake hole, the liquid passage, and the liquid outlet.

In one embodiment, the liquid intake hole is disposed above the heating member, or the electronic cigarette further includes a spraying member, one end of the spraying member is in communication with the liquid outlet, the opposite end of the spray member is provided with a spray head located between the heating member and the liquid absorbing member, the spray head faces the lower surface of the heating member.

In one embodiment, the electronic cigarette further includes a base, the base includes an inner housing and an outer housing, the outer housing is sleeved outside the inner housing, a gap between the outer housing and the inner housing constitutes the liquid passage, the liquid outlet is defined at the inner housing, the liquid inlet is defined at the outer housing, the heating element and the liquid absorbing members are received in the inner cavity of the inner housing.

In one embodiment, the electronic cigarette further includes a second detecting device disposed at the liquid intake hole; when the controller receives the shutdown signal of the pump body and the shutdown signal of the heating member, the controller controls the circuit between the heating member and the power source to be opened, and controls the pump body pump the cigarette liquid in the liquid passage into the liquid storage assembly; when the second detecting device detects that no cigarette liquid passes through the liquid intake hole, the controller controls the pump body and the circuit between the power supplies to be opened.

In one embodiment, the electronic cigarette further includes a third detecting device disposed at the liquid outlet, the third detecting device is configured to generate a trigger signal when the smoke liquid flows through the liquid outlet.

In the electronic cigarette of the present disclosure, the liquid absorbing member is configured to adsorb excess smoke liquid, according to the degree of saturation of the liquid absorbing member detected by the first detecting device, the controller disconnects the circuit between the pump body and the power source, and/or controls the circuit connection between the heating member and the power source, so that the heating member works for a certain period of time. Thereby, the liquid absorbing member is controlled to maintain the current degree of saturation or to control the degree of saturation of the liquid absorbing member to be reduced. In this way, to prevent the liquid absorbing member from being used in a state that has reached or is close to the adsorption saturation, thereby reducing the risk of leakage.

The disclosure also provides an atomizing assembly having a liquid leakage prevention function, an atomizer using the atomizing assembly and an electronic cigarette using the same.

In one embodiment, the atomizing assembly includes a heating member, a liquid passage, a liquid intake hole, a liquid outlet, and a collecting device, the liquid intake hole is in communication with the liquid passage, the liquid outlet is in communication with the liquid passage and the heating member, the collecting device is disposed below the heating member for collecting excess cigarette liquid.

In one embodiment, the collecting device is a liquid absorbing member, the collecting device is a unidirectional collection chamber, the collecting device includes a collection chamber and a unidirectional membrane, the collection chamber is provided with at least one opening, each opening being sealed by a unidirectional membrane.

In one embodiment, the atomizing assembly further includes a first detecting device, the first detecting device is disposed on the liquid absorbing member, the first detecting device is configured to detect the degree of saturation of the liquid absorbing member.

In one embodiment, the liquid absorbing member is made of porous ceramic, the liquid absorbing member is attached to the heating member.

In one embodiment, the liquid outlet is disposed above the heating member, or the atomizing assembly further includes a spraying member, one end of the spraying member is in communication with the liquid outlet, the opposite end of the spraying member is provided with a spray head between the heating member and the collecting device, the spray head faces the lower surface of the heating member.

In one embodiment, the atomizing assembly further includes a base, the base includes an inner housing and an outer housing, the outer housing is sleeved outside the inner housing, a gap between the outer housing and the inner housing constitutes the liquid passage, the liquid outlet is defined at the inner housing, the liquid inlet is defined at the outer housing, the heating element and the liquid absorbing members are received in the inner cavity of the inner housing.

In one embodiment, the atomizing assembly further includes a third detecting device disposed at the liquid outlet, the third detecting device is configured to generate a trigger signal when the smoke liquid flows through the liquid outlet.

An atomizer including a liquid storage assembly and any one of the above atomizing assemblies, the liquid intake hole is in communication with the liquid storage assembly.

In one embodiment, the atomizer further includes an outer casing, and the atomizing structure is received in the outer casing, the outer casing is provided with a partially transparent area, the transparent area of the outer casing is corresponding to the position of the liquid outlet.

An electronic cigarette includes any of the above of the atomizers.

The beneficial effects of the device are:

The collecting device is located below the heating member, the collecting device can collect excess cigarette liquid, thereby preventing the electronic cigarette from leaking. The first detecting device is provided on the liquid absorbing member, the first detecting device detects the degree of saturation of the liquid absorbing member. When the degree of saturation of the liquid absorbing member is greater than or equal to the first threshold value, hereby, the liquid absorbing member is controlled to maintain the current degree of saturation or to control the degree of saturation of the liquid absorbing member to be reduced. Thereby, preventing the liquid absorbing member from being used in a state that has reached or is close to the adsorption saturation, thereby reducing the risk of leakage.

Figure 1:
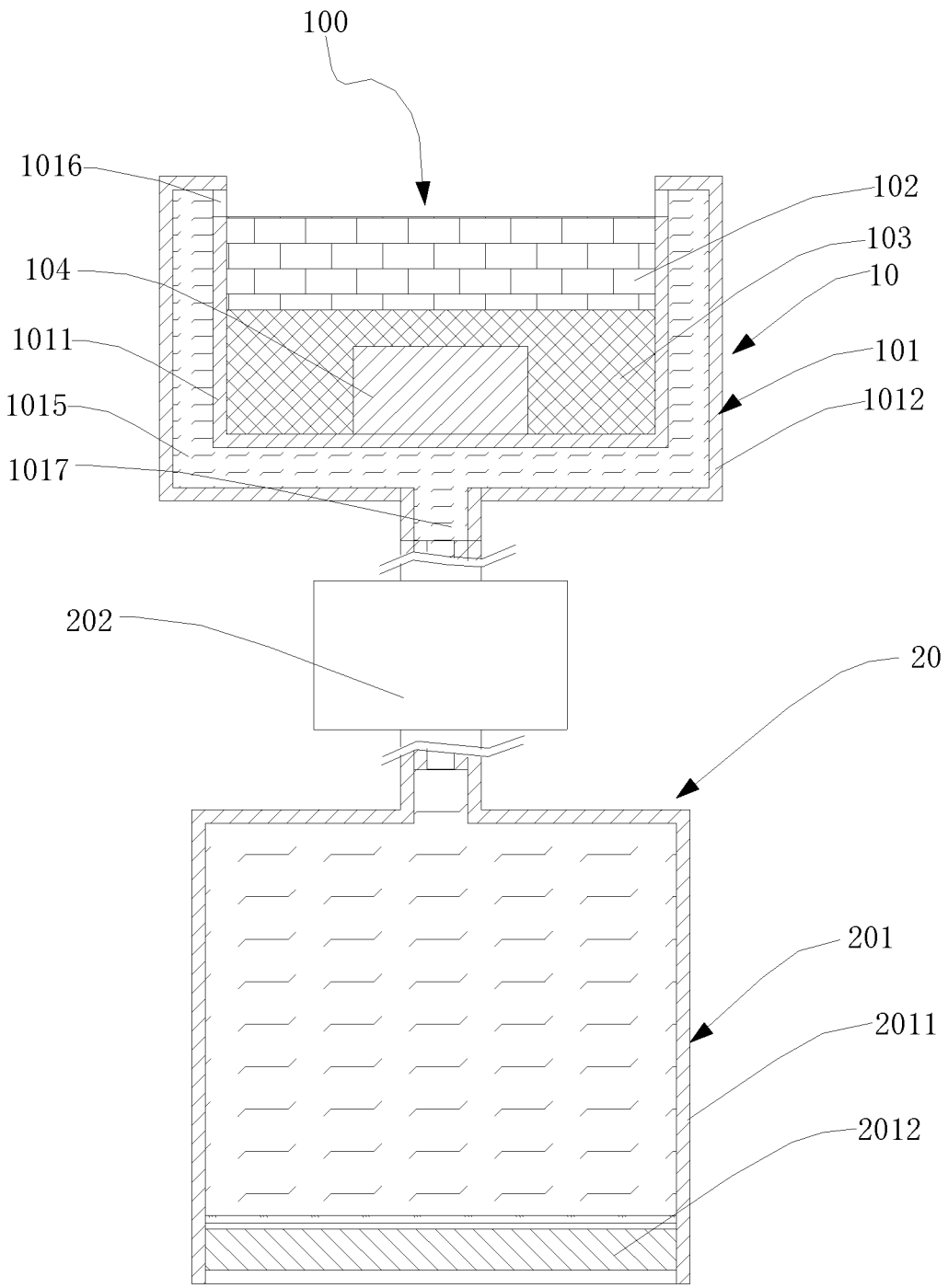
FIG. 1 is a schematic view of an atomizer of an electronic cigarette according to the present disclosure.

The following table list various components and reference numerals thereof.

| | |
|---|---|
| Atomizer 100 | Atomizing assembly 10 |
| Heating member 102 | Liquid absorbing member 103 |
| Inner housing 1011 | Outer housing 1012 |
| Liquid passage 1015 | Liquid outlet 1016 |
| Pump body 202 | Controller 31 |
| Liquid storage assembly 20 | Base 101 |
| First detecting device 104 | Spraying member 105 |
| Liquid storage cartridge 2011 | Piston 2012 |
| liquid intake hole 1017 | Liquid storage assembly 201 |
| Power source 32 | Alarm device 40 |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Referring to FIG. 1, the present disclosure provides an electronic cigarette including an atomizer 100, a mouthpiece (not shown), and a battery assembly (not shown). The atomizer 100 is electrically connected to the battery assembly, the mouthpiece is in communication with the atomizer 100. The atomizer 100 heats the cigarette liquid under the electric drive of the battery assembly, so that the cigarette liquid is atomized into smoke, the user inhales the smoke through the mouthpiece to obtain a smoking experience.

The atomizer 100 includes an outer casing (not shown), an atomizing assembly 10 and a liquid storage assembly 20. The atomizing assembly 10 and the liquid storage assembly 20 are received in the outer casing. The atomizing assembly 10 is in communication with the liquid storage assembly 20. The liquid storage assembly 20 is configured to store cigarette liquid and supply the cigarette liquid to the atomizing assembly 10. The atomizing assembly 10 heats the cigarette liquid under the electrical drive of the battery assembly.

The atomizing assembly 10 includes a heating member 102, a liquid passage 1015, a liquid intake hole 1017, a liquid outlet 1016, and a collecting device. The liquid intake hole 1017 is in communication with the liquid passage 1015 and the liquid storage assembly 20. The liquid outlet 1016 is in communication with the liquid passage 1015 and the heating member 102. The cigarette liquid in the liquid storage assembly 20 enters the liquid through the liquid intake hole 1017, and then flows from the liquid outlet 1016 to the heating member 102. The collecting device is disposed below the heating member 102 for collecting excess cigarette liquid to prevent leakage. The excess cigarette liquid refers to the cigarette liquid that cannot flow out of the mouthpiece in the form of smoke after flowing out from the liquid outlet 1016. The excess cigarette liquid includes the cigarette liquid that has not been atomized by the heating member 102 and dripped from the heating member 102, the condensate of the cigarette liquid remaining in the electronic cigarette, and the like. It can be understood that, in other embodiments, a liquid storage member is disposed above the heating member 102. The liquid storage member is made of a porous material. The cigarette liquid flows from the liquid outlet 1016 to the liquid storage member and is absorbed by the liquid storage member, the heating member 102 heats the cigarette liquid adsorbed on the liquid storage member. In this way, the cigarette liquid does not accumulate in a large amount on the surface of the heating member 102, the cigarette liquid can be surely heated in time to form smoke.

In the embodiment, the atomizing assembly 10 further includes a base 101 including an inner housing 1011 and an outer housing 1012. The inner housing 1011 has a hollow cylindrical structure with an opening at the upper end, the heating member 102 and the collecting device are sequentially disposed from the top to the bottom in the inner cavity of the inner housing 1011. The inner housing 1011 is located in the outer housing 1012, the gap between the inner housing 1011 and the outer housing 1012 constitutes a liquid passage 1015. The liquid intake hole 1017 is defined at the bottom of the outer housing 1012, the liquid outlet 1016 is defined on the inner housing 1011 and adjacent to the upper end of the inner housing 1011. It can be understood that, the number of the liquid intake hole 1017 the liquid outlet 1016 is at least one, the liquid outlet 1016 is at least one. In the embodiment, the number of the liquid intake port 1017 is one, the number of the liquid outlet 1016 is two, two liquid outlets 1016 are oppositely arranged.

It can be understood that, in other embodiments, the liquid passage 1015 can also be formed by other means, only make sure that the liquid passage 1015 is in communication with the liquid storage assembly 20 through the liquid intake hole 1017, and in communication with the heating member 102 through the liquid outlet 1016. For example, a communication tube is provided, the inner cavity of the communicating tube constitutes the liquid passage 1015.

The relative positional relationship between the liquid outlet 1016 and the heating member 102 can be set according to actual needs, as long as the cigarette liquid can flow from the liquid outlet 1016 to the heating member 102.

Referring to FIG. 1 again, in one embodiment, the liquid outlet 1016 is located above the heating member 102, the cigarette liquid in the liquid passage 1015 can flow to the upper surface of the heating member 102 through the liquid outlet 1016 under the force of gravity. The upper surface of the heating member 102 heats the cigarette liquid, thus the cigarette liquid is atomized into smoke. Smoke vents out through the opening at the upper end of the inner housing 1011 and the mouthpiece in sequence. In the embodiment, the heating member 102 has a flat shape. It will be appreciated that, in other embodiments, the upper surface of the heating member 102 is recessed downwardly, such that the upper surface of the heating member 102 is generally bowl-shaped. Thus, the cigarette liquid can easily flow from the circumferential side of the heating member 102 to the center of the heating member 102, so that the cigarette liquid is evenly distributed on the upper surface of the heating member 102.

Figure 2:
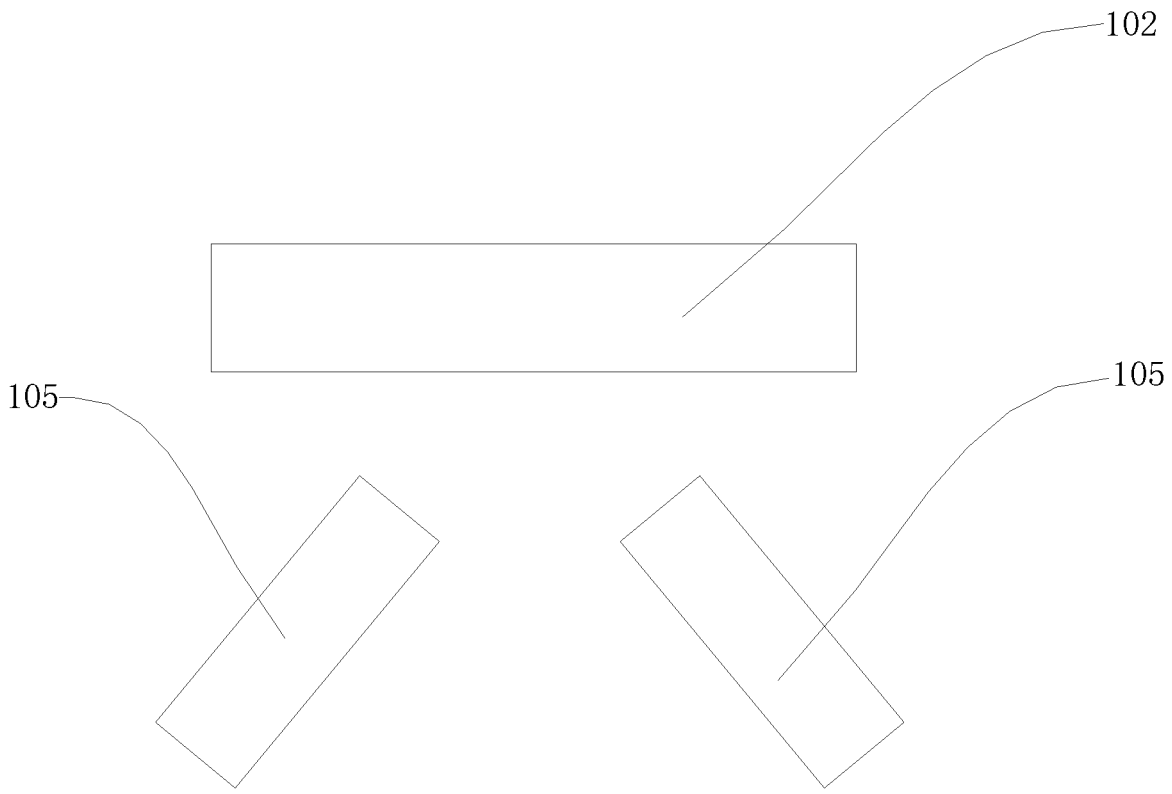
FIG. 2 is a schematic view showing the position of the spray member and the heating member of the electronic cigarette of the present disclosure.

Referring to FIG. 2, in another embodiment, the atomizing assembly 10 further includes a spraying member 105. One end of the spraying member 105 is in communication with the liquid outlet 1016, the opposite end of the spraying member 105 is provided with a spray head between the heating member 102 and the collecting device, the spray head faces the lower surface of the heating member 102. Thus, the cigarette liquid in the liquid passage 1015 can be sprayed onto the lower surface of the heating member 102 through the spray head of the spraying member 105. The pressure applied by the spray head to the cigarette liquid can disperse the cigarette liquid into small droplets. It is understood that, the small droplets are more easily heated and atomized by the heating member 102 than the liquid. In addition, by providing the spraying member 105, the installation position of the liquid outlet 1016 is not limited, as long as the head is located between the heating member 102 and the collecting device, and the head towards to the lower surface of the heating member 102. By disposing the spray head in this way, the sprayed cigarette liquid can be confined between the heating member 102 and the collecting device to prevent the cigarette liquid from splashing around and causing liquid leakage. In order to facilitate the outflow of smoke, the heating member 102 is provided with a through hole and/or a gap located between the heating member 102 and the inner housing 1011. The smoke generated on the lower surface of the heating member 102 can flow to the opening of the upper end of the inner housing 1011 through the through hole and/or the gap, finally, it flows out through the mouthpiece.

In this embodiment, the collecting device is a liquid absorbing member 103. The liquid absorbing member 103 is made of a porous material such as porous ceramic, cotton, cotton, glass fiber, metal foam, or the like. The liquid absorbing member 103 is disposed under the heating member 102. It can be understood that, the upper surface of the liquid absorbing member 103 contacts with the lower surface of the heating member 102, or the upper surface of the liquid absorbing member 103 is spaced apart from the lower surface of the heating member 102, as long as the liquid absorbing member 103 can adsorb excess cigarette liquid. It can be understood that, the liquid absorbing member 103 has a liquid-locking function, no matter how the e-cigarette is placed, the excess cigarette liquid will not leak out of the collecting device. In this embodiment, on the one hand, the liquid absorbing member 103 is made of porous ceramic, so that the liquid absorbing member 103 can also withstand high temperature, preventing the liquid absorbing member 103 from being carbonized under the heat of the heating member 102, and prolonging the liquid absorbing member 103. On the other hand, the liquid absorbing member 103 is in contact with the heating member 102. Thus, the cigarette liquid absorbed at the liquid absorbing member 103 can be reused, the liquid absorbing member 103 can be prevented from being replaced due to adsorption saturation.

It will be appreciated that, in other embodiments, other forms of collecting devices having a liquid locking function may also be provided. For example, the collecting device is a unidirectional collection chamber. Specifically, the collecting device includes a collection chamber and a unidirectional membrane, the collection chamber is provided with at least one opening, each opening being sealed by a unidirectional membrane. In this way, the cigarette liquid can enter the collection chamber through the unidirectional membrane, but due to the unidirectionality of the unidirectional membrane, it will not flow out of the collection chamber through the unidirectional membrane. In one embodiment, the unidirectional membrane is disposed under the heating member 102, the circumferential side of the unidirectional membrane is sealingly attached to the peripheral wall of the inner housing 1011, the inner cavity of the inner housing 1011 located below the unidirectional membrane constitutes a collecting chamber.

The liquid storage assembly 20 includes a liquid storage assembly 201 and a pump body 202. The liquid storage assembly 201 is in communication with the pump body 202. The pump body 202 is connected to the bottom of the base 101 to communicate with the liquid intake hole 1017, so that the pump body 202 can pump the cigarette liquid in the liquid storage assembly 201 into the liquid passage 1015 through the liquid intake hole 1017.

The liquid storage assembly 201 includes a liquid storage cartridge 2011 and a piston 2012. One end of the liquid storage cartridge 2011 is connected to the pump body 202, the piston 2012 is movably received in the opposite end of the liquid storage cartridge 2011. It can be understood that, when the cigarette liquid in the liquid storage cartridge 2011 is reduced, the piston 2012 will move upward under the action of atmospheric pressure, whereby the pressure inside and outside of the liquid storage cartridge 2011 can be balanced, so that the pump body 202 can pump cigarette liquid in the liquid storage cartridge 2011. It can be understood that, in other embodiments, the liquid storage cartridge 2011 is made of a soft material, when the cigarette liquid in the liquid storage cartridge 2011 is reduced, the liquid storage cartridge 2011 is contracted and deformed inward, can also play a role in balancing the pressure inside and outside of the liquid storage cartridge 2011.

When assembling, one end of the pump body 202 is connected to the atomizing assembly 10, the opposite end of the pump body 202 is connected to the liquid storage assembly 201; and then the atomizing assembly 10, the pump body 202 and the liquid storage assembly 201 are housed in the outer casing.

As can be seen from the above, when the collecting device is the liquid absorbing member 103, the collecting device has a state of adsorption saturation. The liquid absorbing member 103 in the state of adsorption saturation cannot continue to adsorb excess cigarette liquid. During use, when the liquid absorbing member 103 is saturated with cigarette liquid, the electronic cigarette will have a risk of liquid leakage. For this reason, it is necessary to detect the adsorption state of the liquid absorbing member 103 so as to stop the liquid supply and remind the user to replace the liquid absorbing member 103 when it is saturated.

Figure 3:
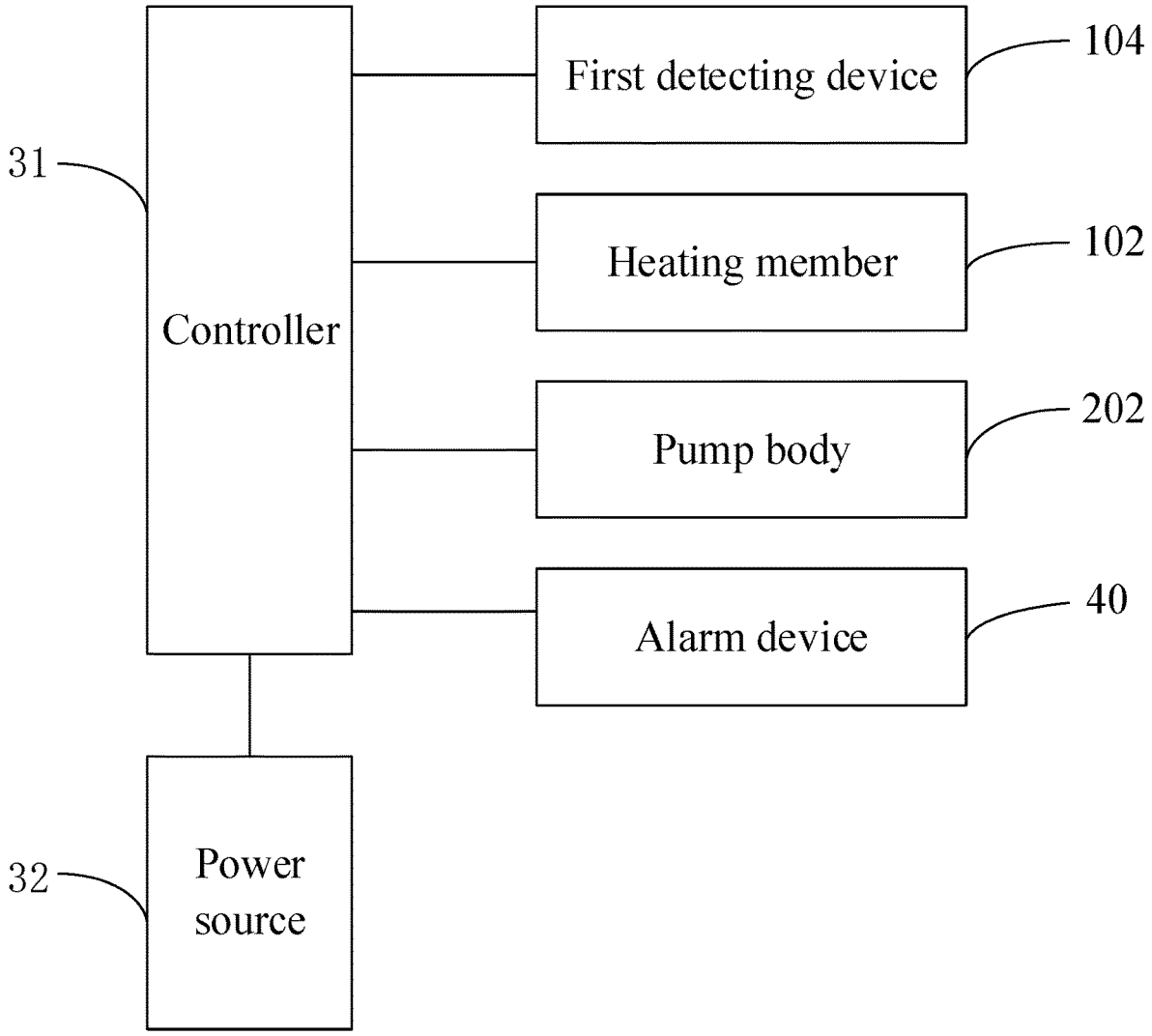
FIG. 3 is a block diagram of the electric circuit of the electronic cigarette of the present disclosure.

Referring to FIGS. 1 and 3, the atomizing assembly 10 further includes a first detecting device 104. The first detecting device 104 is disposed on the liquid absorbing member 103, the first detecting device 104 is configured to detect the degree of saturation of the liquid absorbing member 103. The battery assembly includes a controller 31 and a power source 32. The controller 31 is electrically connected to the first detecting device 104, the pump body 202, and the power source 32, respectively. The first detecting device 104 feeds back the detected the degree of saturation of the liquid absorbing member 103 to the controller 31. The controller 31 compares the degree of saturation of the liquid absorbing member 103 fed back by the first detecting device 104 with a previously stored first threshold value. The first threshold value can be stored in a memory of the electronic cigarette or can be stored in a memory of another device (for example, a mobile phone, a computer, etc.), which is not limited herein. When the degree of saturation is less than the first threshold value, the controller 31 controls the pump body 202 to operate for a certain period of time (for example, 2 seconds), and after the certain period of operation, the controller 31 controls the first detecting device 104 to detect the degree of saturation of the liquid absorbing member 103 again. When the degree of saturation is greater than or equal to the first threshold value, the controller 31 controls the circuit between the pump body 202 and the power source 32 to be opened, so that the pump body 202 stops supplying liquid to the atomizing assembly 10. The degree of saturation refers to the degree of infiltration by the cigarette liquid after the liquid absorbing member 103 absorbs the cigarette liquid. It can be understood that, the infiltration of the cigarette liquid into the liquid absorbing member 103 causes a change in physical quantities such as gravity, humidity, electric resistance, capacitance, etc., the first detecting device 104 detects one of the physical quantities which can be used to indicate the degree of saturation. When the degree of saturation is greater than or equal to the first threshold value, it indicates that the liquid absorbing member 103 has reached or approached the state of adsorption saturation, the liquid absorbing member 103 cannot continue to absorb furthermore excess cigarette liquid or the ability to absorb excess cigarette liquid is extremely weak. At this point, stopping liquid supply, the risk of liquid leakage can be reduced.

Further, the electronic cigarette further includes an alarm device 40, the controller 31 is also electrically connected to the heating member 102 and the alarm device 40. When the degree of saturation is less than the first threshold value, the controller 31 also controls the heating member 102 to operate for a certain period of time. It will be appreciated that, in one of the embodiments, the duration of operation of the heating member 102 is the same as the length of time the pump body 202 is operated. When the degree of saturation is greater than or equal to the first threshold value, the controller 31 also controls the circuit between the heating member 102 and the power source 32 to be opened and instruct the alarm device 40 to transmit an alarm signal. The alarm signal is configured to remind the user that the liquid absorbing member 103 cannot continue to absorb excess cigarette liquid or the ability to absorb excess cigarette liquid is extremely weak, whereby reminds the user to replace the liquid absorbing member 103. The alarm device 40 can transmit an alarm signal by methods of vibration, ringing, displaying reminding message, or indicating lights. Disconnecting the circuit between the heating member 102 and the power source 32 can cause the temperature of the heating member 102 to gradually decrease, thereby allowing the user to change the liquid absorbing member 103 at a relatively safe temperature.

Figure 4:
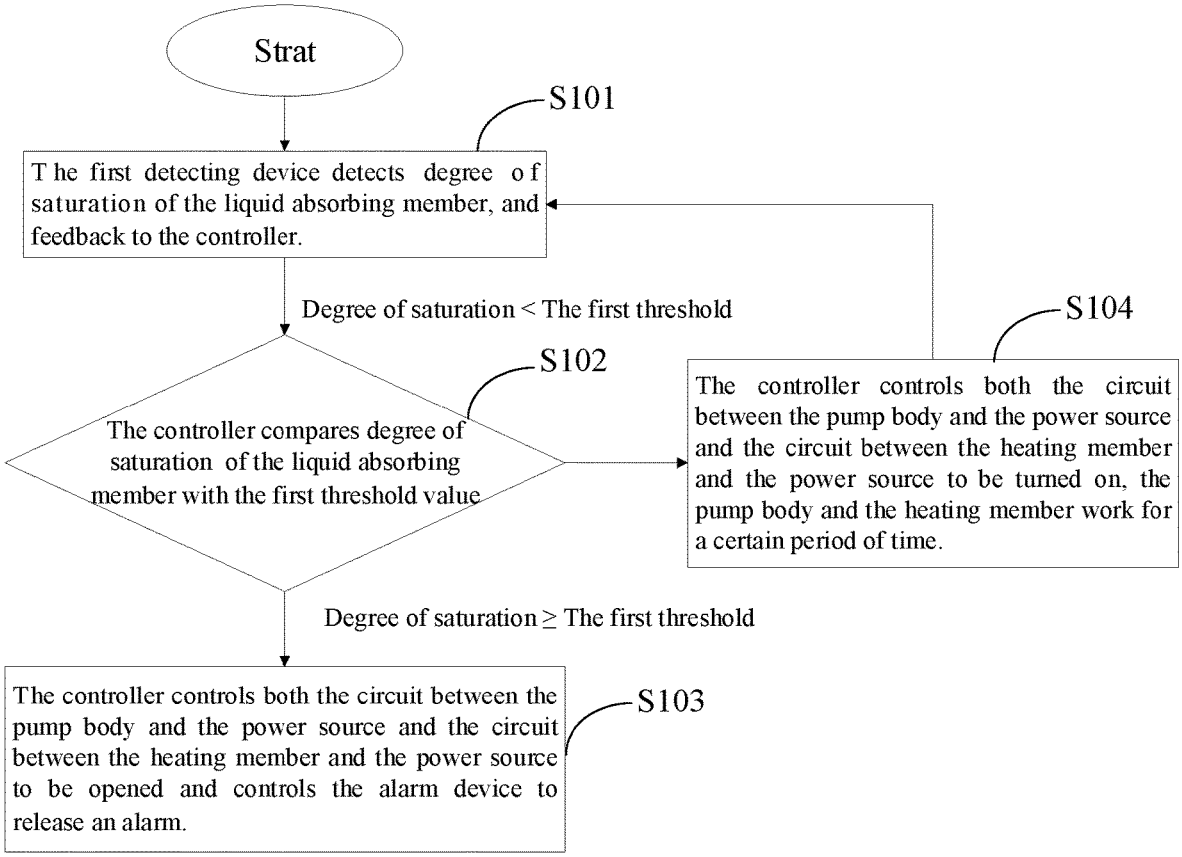
FIG. 4 is a first working flowchart of the electronic cigarette of the present disclosure.

Referring to FIG. 4, a working flowchart of the electronic cigarette with the circuit shown in FIG. 3 may include any or all of the following steps, and in orders other than described below.

Step S101, the first detecting device 104 detects the degree of saturation of the liquid absorbing member 103, and feedback to the controller 31, and then proceeds to step S102.

Step S102, the controller 31 compares the degree of saturation of the liquid absorbing member 103 with the first threshold value. When the degree of saturation is greater than or equal to the first threshold value, the process proceeds to step S103; when the degree of saturation is less than degree of saturation of the first threshold value, the process proceeds to step S104.

Step S103, the controller 31 controls both the circuit between the pump body 202 and the power source 32 and the circuit between the heating member 102 and the power source 32 to be opened and instructs the alarm device 40 to transmit an alarm signal.

Step S104, the controller 31 controls both the circuit between the pump body 202 and the power source 32 and the circuit between the heating member 102 and the power source 32 to be turned on, the pump body 202 and the heating member 102 work for a certain period of time, and then returns to Step S101.

Figure 5:
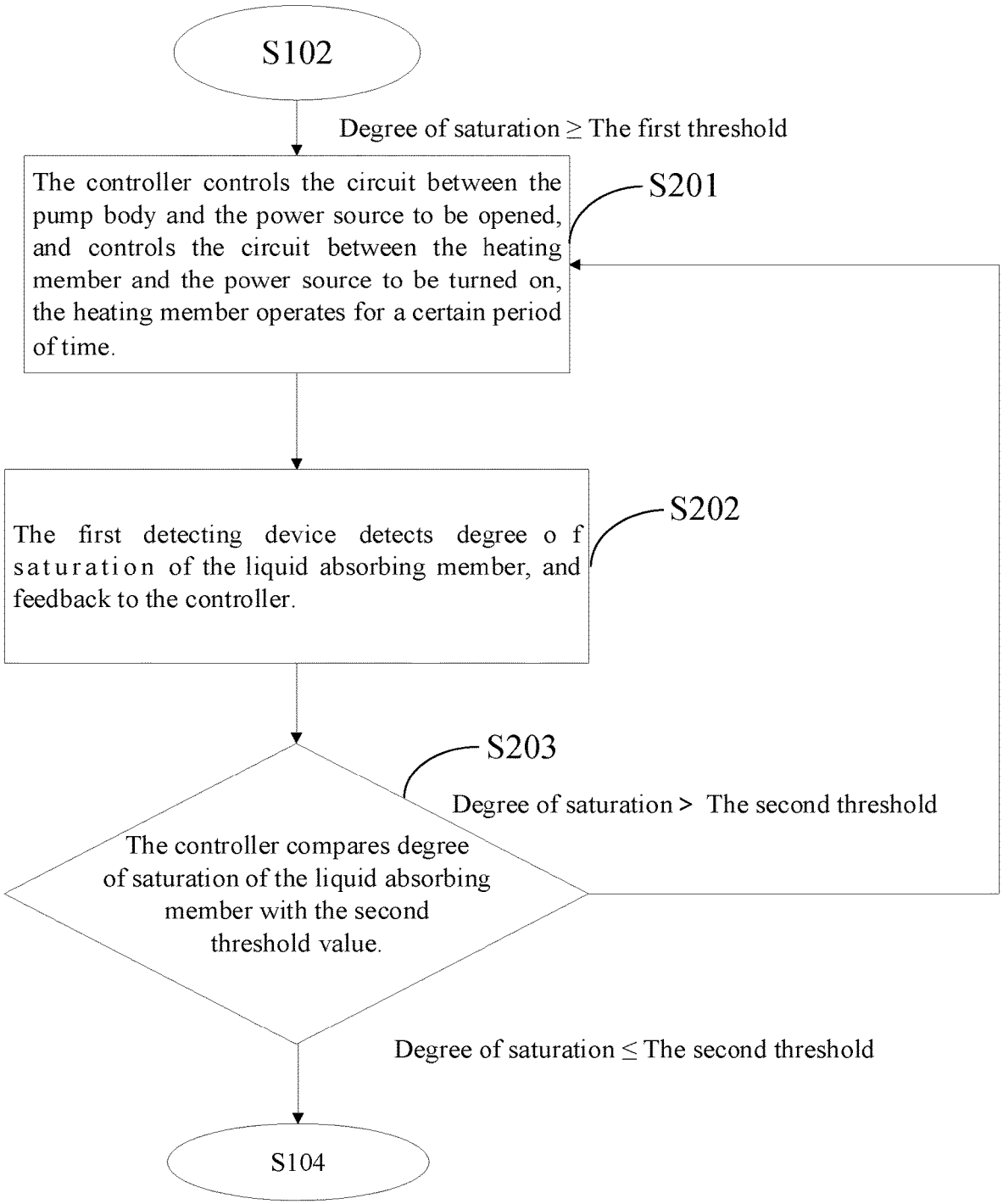
FIG. 5 is a second working flowchart of the electronic cigarette of the present disclosure.

As can be seen from the above, in the embodiment, the liquid absorbing member 103 is attached to the heating member 102. Therefore, when the liquid absorbing member 103 is at saturation, instead of prompting to the user to replace, the circuit between the pump body 202 and the power source 32 can be opened, so that the heating member 102 heats the cigarette liquid on the liquid absorbing member 103. When the amount of absorbed cigarette liquid on the liquid absorbing member 103 decrease to a certain extent, the liquid absorbing member 103 will return to a state having a strong liquid absorbing ability. Specifically, the controller 31 compares the degree of saturation of the liquid absorbing member 103 with a second threshold value stored in advance, the second threshold value is less than the first threshold value. When the degree of saturation of the liquid absorbing member 103 is greater than or equal to the second threshold value, it indicates that there is no cigarette liquid or a small amount of cigarette liquid on the liquid absorbing member 103, the liquid absorbing member 103 can be used normally again. Further, referring to FIG. 5, when the degree of saturation is greater than or equal to the first threshold value, instead of proceeding to step S103, the electronic cigarette proceeds to step S201, so that the electronic cigarette enters the self-cleaning mode from the working mode. In the self-cleaning mode, the workflow of the electronic cigarette is:

Step S201, the controller 31 controls the circuit between the pump body 202 and the power source 32 to be opened, and controls the circuit between the heating member 102 and the power source 32 to be turned on, so that the heating member 102 operates for a certain period of time, for example, 2 seconds; then, proceeding to step S202;

Step S202, the first detecting device 104 detects the degree of saturation of the liquid absorbing member 103, and feedback to the controller 31, and then proceeds to step S203.

Step S203, the controller 31 compares the degree of saturation of the liquid absorbing member 103 with the second threshold value. When the degree of saturation is greater than the second threshold value, the process returns to step S201; when the degree of saturation is less than the second threshold value, the process proceeds to step S104.

It can be understood that, when the degree of saturation is greater than or equal to the second threshold value, indicating that the self-cleaning has ended, the process proceeds to step S104. Such that, the electronic cigarette continues to work; or, the electronic cigarette receives a shutdown signal of the pump body 202 and a shutdown signal of the heating member 102, to turn off the electronic cigarette. In one embodiment, in order to prevent the heating member 102 from being dry-burned due to the liquid storage assembly 20 not being supplied in time, when the electronic cigarette is used again after cleaning, after the self-cleaning, the liquid absorbing member 103 remains some of cigarette liquid. At this time, 0<the second threshold value < the first threshold value.

Referring again to FIG. 1, after use, some of cigarette liquid may remain in the liquid passage 1015. Various measures can be taken out to prevent the cigarette liquid remained in the liquid passage 1015 from leaking. In one embodiment, a solenoid valve (not shown) is disposed in the liquid outlet 1016. When the controller 31 receives the shutdown signal of the pump body 202 and the shutdown signal of the heating member 102 (indicating that the user desires to end the use of the electronic cigarette), the controller 31 controls both the circuit between the pump body 202 and the power source 32 and the circuit between the heating member 102 and the power source 32 to be opened, and instructs the solenoid valve to close the liquid outlet 1016. In another embodiment, a second detecting device (not shown) is disposed at the liquid intake hole 1017, when the controller 31 receives the shutdown signal of the pump body 202 and the shutdown signal of the heating member 102, the controller 31 controls the circuit between the heating member 102 and the power source 32 to be opened, the pump body 202 is controlled to pump the cigarette liquid in the cigarette liquid passage 1015 into the liquid storage cartridge 2011 until the second detecting device detects that no more cigarette liquid flows. The liquid intake port 1017, the controller 31 controls the circuit between the pump body 202 and the power source 32 to be opened. The second detecting device is a liquid sensing switch.

In the embodiment, by closing the pump body 202 and the heating member 102, the liquid absorbing member 103 has sufficient capacity to absorb the cigarette liquid in the liquid passage 1015 to prevent liquid leakage. The controller 31 is also compared with a third threshold value stored in advance (the third threshold value<the first threshold value), when the degree of saturation of the liquid absorbing member 103 is greater than or equal to the third threshold value, it indicates that the volume of the cigarette liquid that the liquid absorbing member 103 can further absorb is larger than the volume of the liquid passage 1015. The degree of saturation Q=kx ("x" presents the volume of the adsorbed cigarette liquid, "k" is defined as the proportional coefficient), the volume in the liquid passage 1015 is b, the maximum liquid absorption of the liquid absorbing member 103 is a, the third threshold value≤k (ab). After use, the first detecting device 104 detects the degree of saturation of the liquid absorbing member 103. When the degree of saturation of the liquid absorbing member 103 is less than the third threshold value, the heating element 102 stops heating.

Figure 6:
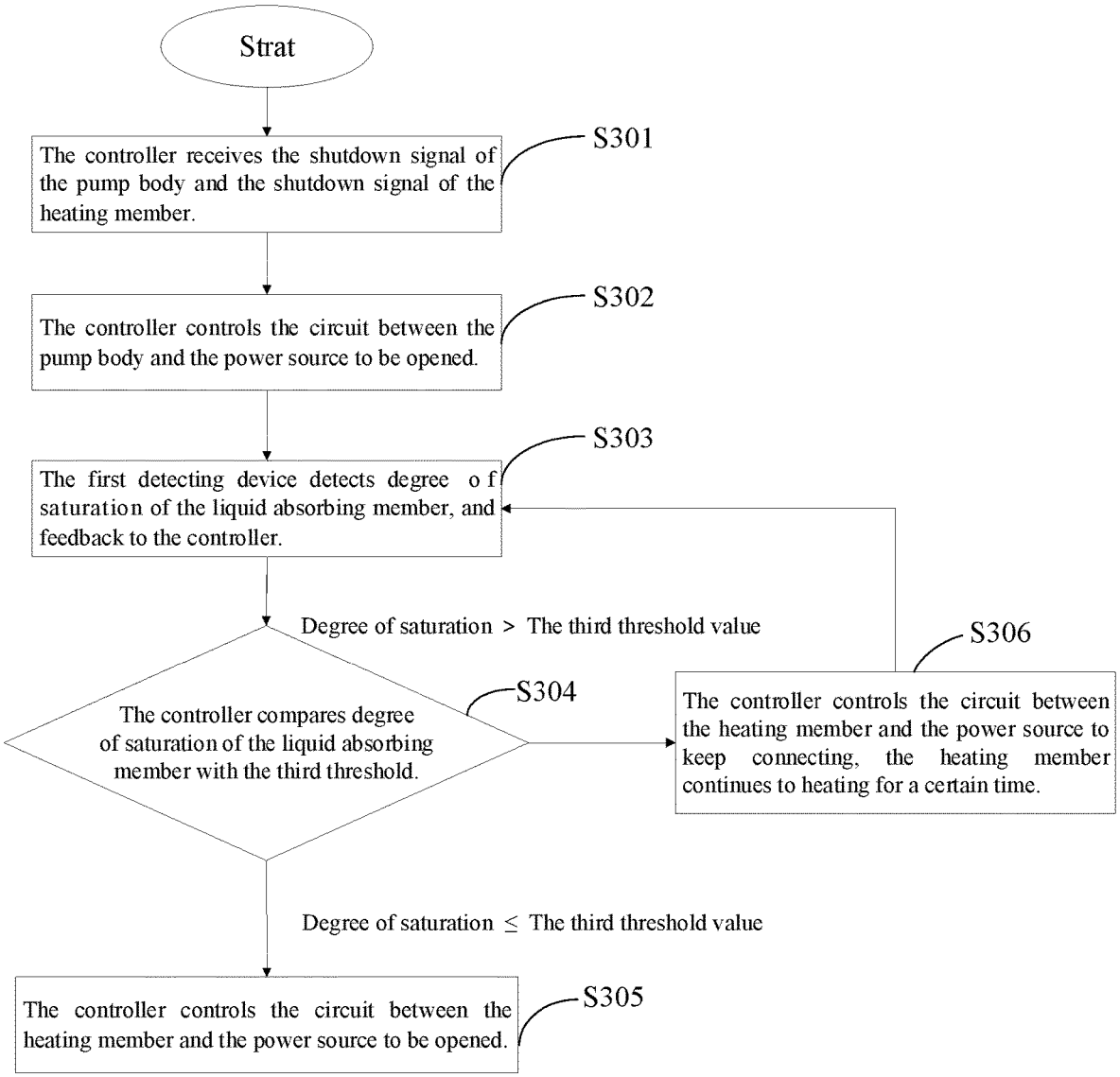
FIG. 6 is a third working flowchart of the electronic cigarette of the present disclosure.

When the degree of saturation of the liquid absorbing member 103 is greater than or equal to the third threshold value, the heating member 102 continues to work until the degree of saturation of the liquid absorbing member 103 is less than the third threshold value. Therefore, it can be ensured that the liquid absorbing member 103 has sufficient capacity to absorb the cigarette liquid in the liquid passage 1015, thereby reducing the risk of leakage. Referring to FIG. 6, the working steps of the electronic cigarette includes:

Step S301, the controller 31 receives the shutdown signal of the pump body 202 and the shutdown signal of the heating member 102, and then proceeds to step S302;

Step S302, the controller 31 controls the circuit between the pump body 202 and the power source 32 to be opened, and then proceeds to step S303;

Step S303, the first detecting device 104 detects the degree of saturation of the liquid absorbing member 103, and feedback to the controller 31, and then proceeds to step S304;

In step S304, the controller 31 compares the degree of saturation of the liquid absorbing member 103 with the third threshold value. When the degree of saturation is less than the third threshold value, the process proceeds to step S305. When the degree of saturation is greater than the third threshold value, the process proceeds to step S306.

Step S305, the controller 31 controls the circuit between the heating member 102 and the power source 32 to be opened;

Step S306, the controller 31 controls the circuit between the heating member 102 and the power source 32 to keep connecting, so that the heating member 102 continues to heating for a certain time, and then returns to the step S303.

It should be noted that, the heating member 102 is attached to the liquid absorbing member 103. The heating member 102 can directly conduct heat to the liquid absorbing member 103, thereby can accelerate the transfer of cigarette liquid absorbed in the liquid absorbing member 103 towards the heating element and reduce the degree of saturation of the liquid absorbing member 103. It can be understood that, the heating member 102 and the liquid absorbing member 103 can also be spaced apart. The liquid absorbing member 103 is heated by the heat of the heating member 102 transferred by at least one of the following method: indirect heat conduction, heat convection, and heat radiation, thereby causing the cigarette liquid to be desorbed from the liquid absorbing member 103. When the heating power of the heating member 102 is increased, even if the circuit between the pump body 202 and the power source 32 is connected, the cigarette liquid absorbed on the liquid absorbing member 103 can be reduced.

In addition, it should be noted that, the liquid passage 1015 has a certain length. In use, the cigarette liquid flows to the liquid outlet 1016, and then flows to the heating member 102 through the liquid outlet 1016. When there is no cigarette liquid at the liquid outlet 1016 before use, it will take a certain time after the pump body 202 is started, so that the cigarette liquid flows to the liquid outlet 1016 firstly. After the pump body 202 starts working, when the heating member 102 is activated before the cigarette liquid has flowed to the liquid outlet 1016, the heating member 102 is easily dried. In one embodiment, a third detecting device is disposed at the liquid outlet 1016. It can be understood that, when the third detecting device detects that the cigarette liquid flows through the liquid outlet 1016, the third detecting device generates a trigger signal to enable the heating member 102 to start the heating function. The third detecting device is a liquid sensing switch. In another embodiment, the outer casing is provided with a partially transparent area, the transparent area of the outer casing is corresponding to the position of the liquid outlet 1016. The transparent area is configured to observe whether there is cigarette liquid flowing to the liquid outlet 1016. After observing the liquid flow into the liquid outlet 1016, the user can activate the heating member 102.

In the present disclosure, the collecting device is located below the heating member 102, the collecting device can collect excess cigarette liquid, thereby preventing the electronic cigarette from leaking. When the collecting device is a liquid absorbing member 103, the first detecting device 104 detects the degree of saturation of the liquid absorbing member 103, the controller 31 compares the degree of saturation of the liquid absorbing member 103 with the first threshold value. When the wettability of the liquid absorbing member 103 is greater than or equal to the first threshold value, it is indicated that the liquid absorbing member 103 has reached or approached the adsorption saturation state. At this time, the user can replace the liquid absorbing member 103 or enable the self-cleaning mode to return the liquid absorbing member 103 to the usable state, thereby preventing the liquid absorbing member 103 from being used in a state that has reached or is close to the adsorption saturation, thereby reducing the risk of leakage.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A control method of an electronic cigarette having an atomizing assembly comprising a first detecting device, a heating member, a liquid absorbing member, a controller and a pump body, the pump body is configured to supplying a cigarette liquid to the heating member, the heating member is for heating the cigarette liquid, the liquid absorbing member is for adsorbing excess cigarette liquid, the control method comprising:

the first detecting device detects a degree of saturation of the liquid absorbing member, and feedback to the controller;

the controller compares the degree of saturation of the liquid absorbing member with a first threshold value; and when the degree of saturation is greater than or equal to the first threshold value, the controller controls the liquid absorbing member to maintain the current degree of saturation or to control the degree of saturation of the liquid absorbing member to be reduced.

2. The control method according to claim 1, wherein the control method further includes the following step after comparing the degree of saturation of the liquid absorbing member with the first threshold value:

when the degree of saturation is less than the first threshold value, returning to the step of detecting the degree of saturation of the liquid absorbing member by the first detecting device and feeding back to the controller.

3. The control method according to claim 1, wherein the electronic cigarette further includes an alarm device, the control method further includes:

when the degree of saturation is greater or less than the first threshold value, the controller instructs the alarm device to transmit an alarm signal.

4. The control method according to claim 1, wherein the step of controlling the liquid absorbing member to maintain the current degree of saturation or to control the decrease in the degree of saturation of the liquid absorbing member includes the following step:

the controller controls a circuit between the pump body and the power source to be opened, and/or controls a circuit between the heating member and the power source to be turned on, to make the heating member operates for a period of time.

5. The control method according to claim 4, wherein the control method further includes following steps after controlling circuit between the pump body and the power source to be opened, and/or controls the circuit between the heating member and the power source to be turned on, to make the heating member operates for a period of time:

the first detecting device detects the degree of saturation of the liquid absorbing member and feeds back to the controller;

the controller compares the degree of saturation of the liquid absorbing member with a second threshold value stored in advance;

when the degree of saturation is greater than the second threshold value, the controller controls the circuit between the pump body and the power source to be opened, and controls the circuit between the heating member and the power source to be turned on, so that the heating member operates for a certain period of time; the second threshold value is less than the first threshold value.

6. The control method according to claim 5, wherein the control method further includes the following step after comparing the degree of saturation of the liquid absorbing member with a second threshold value stored in advance:

when the degree of saturation is less than or equal to the second threshold value, the controller controls the circuit between the pump body and the power source to be turn on and the circuit between the heating member and the power source to be turn on, so that the pump body and the heating member work for a period of time.

7. The control method according to claim 5, wherein the control method further includes:

when the degree of saturation is less than or equal to the second threshold value, the controller receives the shutdown signal of the pump body and the shutdown signal of the heating member;

the controller controls the circuit between the pump body and the power source to be opened and controls the circuit between the heating member and the power source to be opened.

8. The control method according to claim 1, wherein the control method further includes:

the controller receives a shutdown signal of the pump body and a shutdown signal of the heating member;

the controller controls a circuit between the pump body and the power source to be opened;

the first detecting device detects the degree of saturation of the liquid absorbing member and feeds back to the controller;

the controller compares the degree of saturation of the liquid absorbing member with a third threshold value stored in advance;

when the degree of saturation is less than or equal to the third threshold value, the controller controls the circuit between the heating member and the power source to be opened, the third threshold value is less than the first threshold value.

9. The control method according to claim 8, wherein the control method further includes the following steps after comparing the degree of saturation of the liquid absorbing member with a third threshold value stored in advance:

when the degree of saturation is greater than the third threshold value, the controller controls the circuit between the heating member and the power source to keep connecting, so that the heating member continues to operate for a certain period of time, and then the first detecting device detects the degree of saturation of the liquid absorbing member, and feedback to the controller.

10. An electronic cigarette, comprising:

a first detecting device;

a pump body;

a liquid absorbing member configured for absorbing excess cigarette liquid;

a heating member, the pump body is configured to supply the liquid to the heating member, the heating member is configured to heat the cigarette liquid supplied by the pump body;

a power source, and a controller having detecting device configured to detect a degree of saturation of the liquid absorbing member and feedback to the controller, the controller is configured to compares the degree of saturation of the liquid absorbing member with a first threshold value stored in advance; when the degree of saturation is greater than or equal to the first threshold value, the controller is configured to control a circuit between the pump body and the power sources to be opened, and/or control a circuit between the heating member and the power source to be connected to make the heating member operates for a period of time.

11. The electronic cigarette according to claim 10, wherein the electronic cigarette further includes an alarm device, when the degree of saturation is greater than or equal to the first threshold value, the controller is further configured to instructs the alarm device to transmit an alarm signal.

12. The electronic cigarette according to claim 10, wherein the controller is further configured to compares the degree of saturation of the liquid absorbing member with a second threshold value stored in advance; when the degree of saturation is less than or equal to the second threshold value, the controller controls the pump body and the power source are electrically continuous therewith, and also controls the heating member and the power source are electrically continuous therewith, so that the pump body and the heating member working for a period of time, the second threshold value is less than the first threshold value.

13. The electronic cigarette according to claim 10, wherein the controller is further configured to compare the degree of saturation of the liquid absorbing member with a second threshold value stored in advance; when the degree of saturation is less than or equal to the second threshold value, the controller is configured to receive a shutdown signal of the pump body and a shutdown signal of the heating member; when the controller receives the shutdown signal of the pump body and the heating member the controller controls the circuit between the pump body and the power source to be opened and controls circuit between the heating member and the power source to be opened; the second threshold value is less than the first threshold value.

14. The electronic cigarette according to claim 10, wherein the controller is further configured to receive a shutdown signal of the pump body and a shutdown signal of the heating member, and when the controller receives the shutdown signal of the pump body and the shutdown signal of the heating member, the controller is configured to control the circuit between the pump body and the power source to be opened;

the controller is configured to compare the degree of saturation of the liquid absorbing member with a third threshold value stored in advance;

when the degree of saturation is less than or equal to the third threshold value, the controller is configured to control a circuit between the heating member and the power source to be opened; the third threshold value is greater than the first threshold value.

15. The electronic cigarette according to claim 10, wherein the liquid absorbing member is made of porous ceramic, the liquid absorbing member is attached to the heating member.

16. The electronic cigarette according to claim 10, wherein the electronic cigarette further includes a liquid passage, a liquid intake hole, a liquid outlet, and a liquid storage assembly for storing the cigarette liquid; the liquid outlets are respectively in communication with the liquid passage and the heating member; the liquid intake hole is respectively in communication with the liquid passage and the pump body, the pump body cooperates with the liquid storage assembly, the pump body supplies the liquid smoke in the liquid storage assembly to the heating member through the liquid intake hole, the liquid passage, and the liquid outlet.

17. The electronic cigarette according to claim 16, wherein the liquid intake hole is disposed above the heating member, or the electronic cigarette further includes a spraying member, one end of the spraying member is in communication with the liquid outlet, the opposite end of the spraying member is provided with a spray head located between the heating member and the liquid absorbing member, the spray head faces the lower surface of the heating member.

18. The electronic cigarette according to claim 16, wherein the electronic cigarette further includes a base, the base includes an inner housing and an outer housing, the outer housing is sleeved outside the inner housing, a gap between the outer housing and the inner housing define the liquid passage, the liquid outlet is defined at the inner housing, the liquid inlet is defined at the outer housing, the heating member and the liquid absorbing member are received in an inner cavity of the inner housing.

19. The electronic cigarette according to claim 16, wherein the electronic cigarette further includes a second detecting device disposed at the liquid intake hole; when the controller receives the shutdown signal of the pump body and the shutdown signal of the heating member, the controller controls the circuit between the heating member and the power source to be opened, and controls the pump body pump the cigarette liquid in the liquid passage into the liquid storage assembly; when the second detecting device detects that no cigarette liquid passes through the liquid intake hole, the controller controls the pump body and the circuit between the power supplies to be opened.

20. The electronic cigarette according to claim 16, wherein the electronic cigarette further includes a third detecting device disposed at the liquid outlet, the third detecting device is configured to generate a trigger signal when the cigarette liquid flows through the liquid outlet.

* * * * *